US006206111B1

(12) United States Patent
Nistor

(10) Patent No.: US 6,206,111 B1
(45) Date of Patent: Mar. 27, 2001

(54) HIGH PRESSURE INTERNAL SLEEVE FOR USE WITH EASILY DRILLABLE EXIT PORTS

(75) Inventor: Radu Nicolae Nistor, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/339,864

(22) Filed: Jun. 25, 1999

(30) Foreign Application Priority Data

Jun. 23, 1999 (CA) ..... 2276222

(51) Int. Cl.[7] ..... E21B 7/08
(52) U.S. Cl. ..... 175/61; 175/79
(58) Field of Search ..... 166/117.5, 117.6, 166/242, 317, 376; 175/61, 45, 74, 78, 79, 80, 81, 75, 322, 321

(56) References Cited

U.S. PATENT DOCUMENTS 4,174,846 11/1979 Scott .
4,415,205 11/1983 Rehm et al. .
4,765,404 * 8/1988 Bailey et al. ..... 166/117.6
5,215,151 * 6/1993 Smith et al. ..... 175/45
5,353,872 * 10/1994 Wittrisch ..... 166/382 X
5,458,209 10/1995 Hayes et al. .
5,484,017 1/1996 Coon .
5,579,829 12/1996 Comeau et al. .
5,615,740 4/1997 Comeau et al. .
5,884,698 3/1999 Hughes et al. .

* cited by examiner

*Primary Examiner*—Robert E. Pezzuto
(74) *Attorney, Agent, or Firm*—Terrence N. Kuharchuk; William Shull; Michael D. McCully

(57) ABSTRACT

A joint of tubular casing with a pre-formed window in its sidewall, has a tubular sleeve fixedly attached to the interior of the tubular casing by a plurality of shearable fastners. The exterior surface of the sleeve is sealed to the interior surface of the tubular casing on opposing sides of the window using a pair of high pressure seal assemblies. The window cavity is filled with a fluid and then the window is covered with one or more layers of a composite material such as fiberglass. In use, the joint of tubular casing is run down to the depth of interest in an earth borehole, and then the window is oriented with respect to the formation of interest at the depth. The joint of tubular casing is then cemented in place, after which the tubular sleeve is retrieved by the use of a fishing tool causing the set screws to shear upon the upward movement of the fishing tool. After the interior sleeve is retrieved, a whipstock is lowered into the cased borehole, until it is oriented and anchored therein.

16 Claims, 3 Drawing Sheets

HIGH PRESSURE INTERNAL SLEEVE FOR USE WITH EASILY DRILLABLE EXIT PORTS

FIELD OF THE INVENTION

This invention relates generally to apparatus used in drilling branch wells from a main well, and more specifically to apparatus for drilling lateral wells from cased wells for purposes of producing oil and gas from subsurface formations.

DESCRIPTION OF THE PRIOR ART

Conventional technology provides for the drilling of a well from the surface to a predetermined depth below the surface into a subterranean formation containing hydrocarbon reserves. Most conventional wells have traditionally been substantially vertical. However, current technology provides for the drilling of deviated or non-vertical wells using directional drilling technology.

Since its usage began, horizontal drilling has offered dramatic reservoir exposure improvements. More recently, the trend has developed towards drilling multiple laterals, thus further increasing production. Until recently, laterals typically were not cased and tied back, which meant when workovers or cleanouts were required, reentry was difficult and completions were virtually impossible.

Now, the technology allows multiple laterals to be cased and tied back. Multilaterals may be drilled into predetermined producing formation quadrants at any time in the productive life cycle of wells and can be used in vertical, directional or horizontal applications.

Minimizing the distance hydrocarbons must travel to the wellbore is an important goal. One surface hole installation can now incorporate an integral casing drainage system that takes the wellbore to the hydrocarbons in place.

The same directional bottomhole assembly used to initiate the kickoff is used to drill the build or turn portion of the lateral wellbore. Once a lateral has been drilled, a secondary liner and hanger system is placed into the newly drilled wellbore and mechanically tied back to the main casing string, allowing future re-entry into the new leg. The deflection device can immediately be moved to the next window joint upon installation of the lateral string.

Either the drilling cycle can commence on the next lateral, or the deflection device can be retrieved to surface, enabling access to all casing strings. The deflection device can, alternatively, be left on bottom, to be available if additional laterals are drilled at some other time, to further improve reservoir recovery based on performance of the original wellbore and its added lateral or laterals.

Additional benefits are that the system creates a natural separator for oil and gas production in vertical applications, and it creates the opportunity to drill, complete and produce from several different formations tied to one surface-hole casing string.

An integral part of the system for drilling either a single lateral well, or a multiple lateral well scenario, is the so-called casing window joint, a joint of steel casing having a pre-cut or pre-formed window which is easily drillable. The casing window system is available in various oilfield-tubular material grades. The completed casing window is then overwrapped with composite materials, similar to fiberglass.

U.S. Pat. No. 4,415,205, issued on Nov. 15, 1983, to William A. Rehm et al., discloses in its Col. 1, lines 56–59; Col. 2, lines 5–8; Col. 3, lines 17–25; and Col. lines 2–8, the use of a special window cut into the steel casing which is covered by fiberglass to provide an easy exit port through which a lateral hole can be easily drilled. In the absence of such a pre-cut hole, the steel casing can be very difficult to drill through, typically requiring the use of a conventional casing mill.

A similar system is described in U.S. Pat. No. 5,458,209, issued on Oct. 17, 1995, to Hayes et al., in which there is disclosed with respect to its FIGS. 11A, 11B and 11C, the use of a pre-cut opening in the steel casing, covered by fiberglass, which can be easily drilled.

In U.S. Pat. No. 5,615,740, issued Apr. 1, 1997, to Comeau et al., assigned to the assignee of the present invention and incorporated herein by reference, there is disclosed a system for use in pressure environments typical in oil and gas drilling. Comeau et al utilize a pre-cut window in the casing which is covered with an easily drillable material, such as fiberglass. In addition, a retrievable pressure sleeve is fixed within the interior of the casing, adjacent the window in the casing. The sleeve is pressure sealed to the interior of the casing and the window space or cavity between the sleeve and the drillable material wrap filled with fluid to provide protection from pressure damage to the drillable material window covering. Once the casing has been cemented in place, the sleeve can be retrieved to the surface and drilling through the window can commence.

However, the use of such a prior art systems, in which a pre-cut or pre-formed hole is covered with an easily drillable covering, for example, fiberglass, creates an additional problem. The fiberglass covering simply cannot withstand the high pressures frequently encountered in drilling oil and gas wells, sometimes being at 5,000 to 10,000 psi levels. For example, in U.S. Pat. No. 4,415,205, in Col. 5, commencing on line 5, the prior art recognizes the inability of the fiberglass to withstand the pressures encountered at greater depths and that conventional casing mills should be used instead to create the window in the casing. Further, an internal sleeve system such as that described in Comeau et al has not proven entirely satisfactory when dealing with high pressures often encountered in drilling or the cyclic high pressures commonly encountered during the cementing operation, due to the difficulty of creating a high pressure seal between the sleeve and the casing while having the sleeve being easily retrievable from within the casing.

It is therefore the primary object of the present invention to provide a system for drilling lateral wells in high pressure environments using casing having an easily drillable exit port, using an internal pressure sleeve which is easily retrievable from within the casing.

SUMMARY OF THE INVENTION

The objects of the invention are accomplished, generally, by the use of a retrievable pressure sleeve pinned within the interior of the casing, adjacent the window in the casing. The sleeve includes a high pressure sealing system at both ends thereof to seal against high pressure and pressure surges from either inside or outside the casing. Once the casing has been cemented in place, the sleeve is retrieved to the earth's surface.

As an additional feature of the invention, the window cavity between the sleeve and the drillable material covering is filled with a fluid to prevent the covering over the window from deforming inwardly through the window in response to the external pressures encountered in the downhole environment.

BRIEF DESCRIPTION OF THE DRAWINGS

These and other objects, features and advantages of the present invention will be more readily appreciated from a reading of the detailed specification, in conjunction with the drawings, in which.

DETAILED DESCRIPTION OF THE PREFERRED EMBODIMENT

Figure 1:
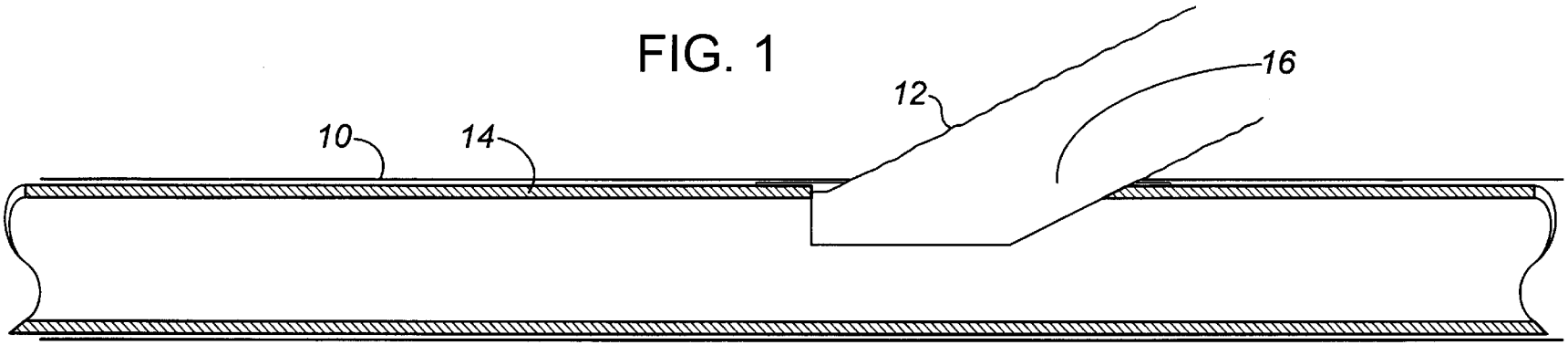
FIG. 1 is a longitudinal sectional view of a junction of a primary well and a secondary well, wherein the primary well contains a casing string defining a lateral window or drill out port.

The present invention is directed to an apparatus and method for providing a pressure sleeve for easily drillable casing exit ports capable of withstanding the high pressure common in the drilling environment. Referring now to FIG. 1, there is shown a wellbore of the type comprising a primary well 10 and at least one secondary well 12. The primary well 10 can be comprised of a substantially vertical well, such that the longitudinal axis of the well 10 is substantially perpendicular to the ground surface, or may be a deviated well, such that the longitudinal axis is not substantially perpendicular to the ground surface. Further, the primary well 10 may not extend directly to the surface, but may be comprised of a lateral or horizontal well which intersects and is in communication with a further vertical or deviated well which then extends to the surface for production of the well.

The primary well 10 is cased such that the primary well 10 contains a tubular, steel casing 14 which is set in place using cement (not shown). The casing string 14 is formed within the primary well 10 using conventional techniques known in the industry. The casing string 14 is illustrated having a pre-cut or pre-formed window or exit port 16 disposed therein. The window 16 provides an exit port for the drill bit to drill the secondary well 12 in a conventional manner, such as that illustrated in U.S. Pat. No. 5,615,740.

Figure 2:
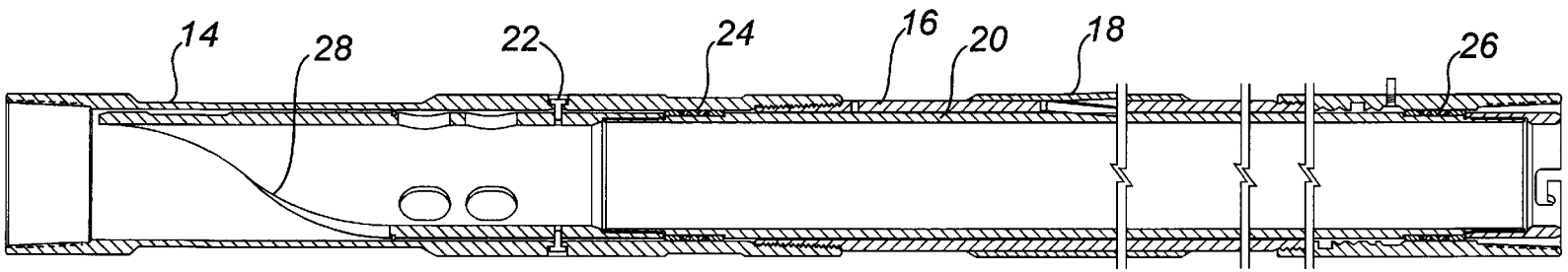
FIG. 2 is an elevated, cross-sectional view of the internal pressure sleeve of the present invention, in place in the interior of a casing having a pre-cut, easily drillable window or hole therein.

Referring now to FIG. 2, a tubular, steel casing 14 is illustrated as having a pre-cut or pre-formed window 16 therein. The outer surface of the casing 14 is wrapped with one or more layers of easily drillable material 18, such as fiberglass, thus providing the easy exit port 16 through the casing 14. The tubular sleeve 20 is located within the interior of the casing 14, held in place by a plurality of shearable fastners 22, such as shearable pins or set screws, which pin the sleeve 20 to the casing 14. Seal assemblies 24 and 26, as will be described in greater detail in relation to FIG. 4 and FIG. 5, prevent any high pressure liquids or gasses from passing from either direction along the annular space between the casing 14 and the tubular sleeve 20 coming from the exit port 16 or from inside the casing 14. A conventional muleshoe 28 is located at the upper end of the tubular sleeve 20 for orienting the casing 14 and the sleeve 20 as appropriate, as described in more detail hereinafter.

In the operation of the system illustrated in FIG. 2, the internal sleeve 20 is pinned in place within the casing 14 at the earth's surface. The combined casing 14 and sleeve 20 are then run into an earth borehole, already drilled by conventional methods, until the exit port 16 is located at the desired vertical depth, within the region of interest in the earth formation. The orientation of the exit port 16 is determined by causing a conventional survey instrument having a complementary muleshoe on its lower end to land on the muleshoe 28. By rotating the casing string from the earth's surface, the exit window 16 is thus oriented. Once the exit port 16 is correctly oriented, the casing 14 is typically cemented in place, in the earth borehole, after which a conventional fishing tool is run from the earth's surface, down through the casing 14, the internal sleeve 20, and out the lower end of the sleeve 20. Although the fishing tool (not illustrated) can take various forms, a typical fishing tool for this operation can have one-way dogs, which spring up upon exiting the lower end if the sleeve 20, and grapple the lower end of sleeve 20. By pulling up on the fishing tool, the shearable fasteners 22 will shear out and the internal pressure sleeve 20 can be retrieved to the earth's surface.

Following retrieval of the internal pressure sleeve 20, a conventional whipstock, such as is illustrated in U.S. Pat. No. 5,615,740, is lowered by a conventional running tool through the casing 14, and once oriented with the orientation of the exit port 16, for example, through the use of a conventional key lug on the interior of the casing 14 is anchored immediately below the exit port 16. With the whipstock anchored in place and its running tool retrieved from the borehole, a conventional drilling operation is commenced, in which a drill bit at the lower end of a drillstring is lowered down to the whipstock and caused to drill off the whipstock, through the drillable material covering the exit port 16, any cement outside the exit port 16, and into the formation of interest. If desired, a keyless orienting and latching system described in U.S. Pat. No. 5 5,579,829, issued Dec. 3, 1996, to Comeau and Vandenberg, which is incorporated hereinafter by reference, can be used.

Those skilled in the art will recognize that this system could sometimes function without the use of the drillable material layer or layers 18. However, the preferred embodiment makes use of the drillable material layer 18 to keep debris in the borehole from entering the exit port into the annulus between the casing 14 and sleeve 20, in between the seal assembly 24 and the seal assembly 26.

As an additional feature of the invention, a generally incompressible fluid is placed in the exit port 16 prior to wrapping the casing 14 with the drillable material 18, thus preventing the drillable material layer 18 from deforming into the exit port 16 when exposed to high pressures external thereto.

Figure 3:
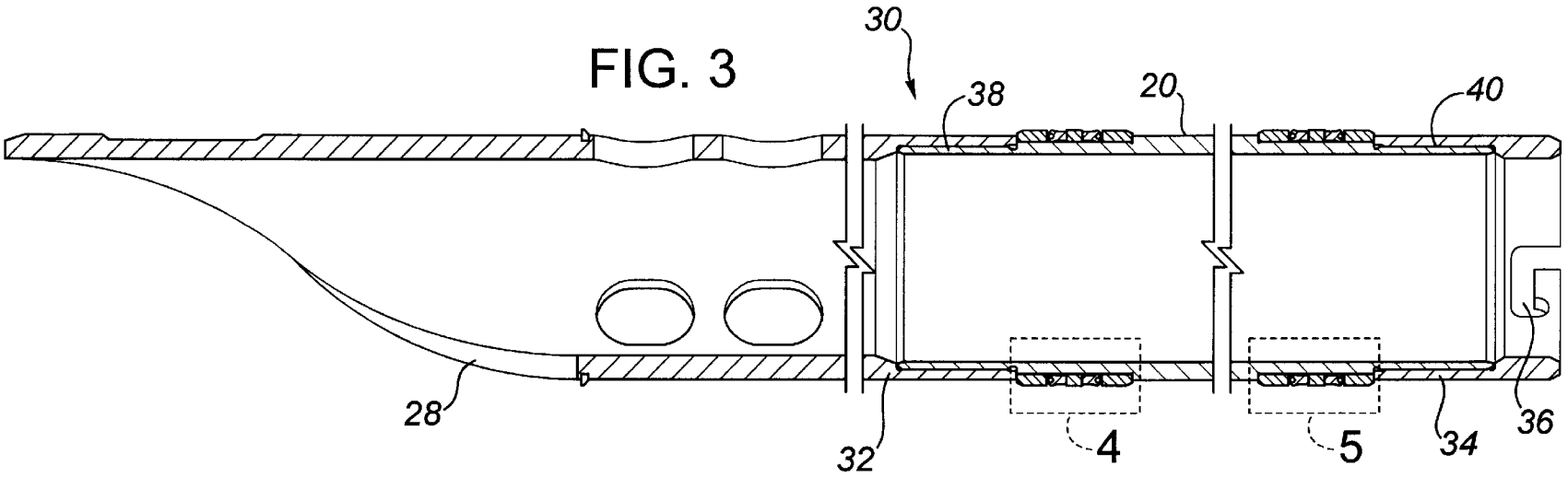
FIG. 3 is an elevated, cross-sectional view of the internal pressure sleeve according to the present invention.

Referring now to FIG. 3, the preferred embodiment of an internal pressure sleeve assembly 30 is illustrated in greater detail. The sleeve assembly 30 has a muleshoe 28 at the upper end of an upper coupling 32. The muleshoe 28, used for determining the orientation of the exit port 16 in the casing 14, is a 44,000 lead taper, single muleshoe. A lower coupling 34, at the lower end of the sleeve assembly 30, has a pair of wrench slots 36, indexed at 180', for tightening the parts of the assembly 30. The slots 36 can also be used for attachment by the fishing tool to facilitate retrieval of the sleeve assembly 30. Intermediate the upper coupling 32 and the lower coupling 34 is a sleeve 20. The sleeve 20 includes a first pin end (male threads) 38 for threadedly engaging the upper coupler 32 and a second box end (female threads) 40 for threadedly engaging the lower coupling 34.

Figure 4:
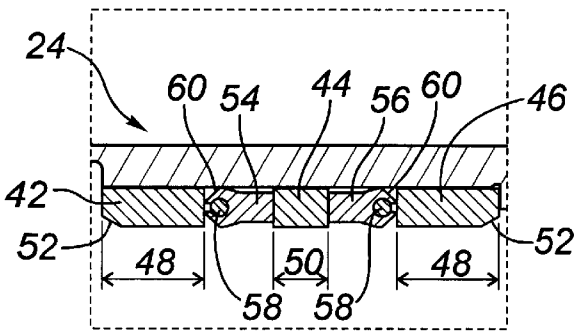
FIG. 4 is an enlarged, elevated, cross-sectional view of the upper seal assembly portion of the internal pressure sleeve according to FIG. 3.
Figure 5:
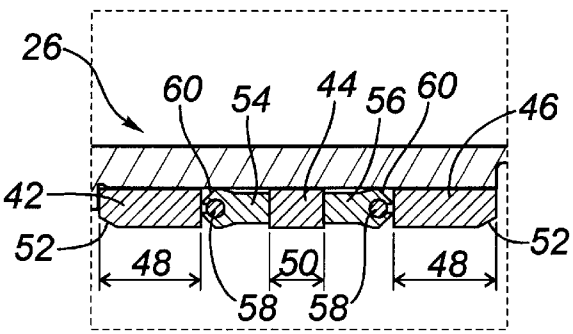
FIG. 5 is an enlarged, elevated, cross-sectional view of the lower seal assembly portion of the internal pressure sleeve according to FIG. 3.

Referring now to FIG. 4 and FIG. 5 there is illustrated in greater detail the upper and lower seal assemblies 24 and 26, respectively, of the present invention. When describing FIG. 4 and FIG. 5 together, common elements will be referred to using common reference numbers. Seal assemblies 24 and 26 include plurality of spacer rings. In the preferred embodiment the spacer rings include a first spacer ring 42, a second spacer ring 44 and a third spacer ring 46. The first spacer ring 42 and the third spacer ring 46 measure approximately 1.0 inch (2.54 cm) across the dimension designated 48, while the second spacer ring 44 measures approximately 0.50 inches (1.27 cm) across the dimension designated 50. The first spacer ring 42 and the third spacer ring 46 include a beveled portion 52.

In the preferred embodiment, the first spacer ring 42, the second spacer ring 44 and the third spacer ring 46 are constructed of a glass based epoxy industrial laminate, such as that commonly referred to as grade G-14. The industrial laminate used has a relatively low impact strength, in the range of approximately 5.50 to 7.00 ft. lbs/inch notch. Thus, when retrieving the sleeve 20 should the sleeve 20 jam in the casing 14 the spacer rings 42, 44 and 46 will easily break allowing retrieval of the sleeve 20. Further, in the preferred embodiment, the spacer rings 42, 44 and 46 have a relatively high compression strength, approximately 30,000 psi (2109.21 kg/cm$^2$) edgewise and 60,000 psi (4218.42 kg/cm$^2$) flatwise.

Each seal assembly 24 and 26 further include a plurality of sealing rings. In the preferred embodiment the sealing rings include a pair of sealing rings 54 and 56 disposed respectively between the first spacer ring 42, and the second spacer ring 44, and the second spacer ring 44 and the third spacer ring 46. In the preferred embodiment, the sealing rings 54 and 56 each comprise a unidirectional pressure and fluid seal which combines an 0-ring type synthetic rubber 0-spring 58 with a lip-type seal 60, as illustrated in FIG. 4 and FIG. 5. More specifically, each sealing ring 54 and 56 comprises a generally U-shaped cup having a pair of lips for forming a cavity therebetween and an elastomeric expander ring mounted within the cavity. Sealing edges on the lips are contacted by the members to be sealed. An example of such sealing rings are known as a Deep PolyPak seal, as sold by Parker Seals of Salt Lake City. PolyPak is believed to be a registered trademark of Parker-Hannifin Corporation. The sealing rings 54 and 56 are mounted to face in opposite directions to protect against pressure from external to the casing and pressure from internal to the casing.

In operation of the seal assemblies 24 and 26 of the present invention, as pressure increases additional force is applied to the seal interface and as pressure continues to increase lip load is automatically increased to compensate for the higher pressure and thus maintain a positive, leak free seal. As the lip loading increases the sealing rings 54 and 56 will push against the adjacent spacer ring member pushing the end of the spacer ring member 44 against the shoulder of the step in the sleeve 20; therefore, the spacer ring members 42, 44 and 46 need high compressive strength to withstand the exerted load. The high pressure internal sleeve of the present invention is capable of withstanding high pressure up to, and in excess of: 14,000 psi (984.30 kg/cm$^2$) at 220 degrees F. (104.44 C.) for a 9.625 inch (24.4575 cm) casing and 6,000 psi (421.84 kg/cm$^2$) at 220 degrees F. (104.44 C.) for a 7.0 inch (17.78 cm) casing.

In the course of practicing the invention, it is contemplated that the following method may be used:

1. Windowed casing joints are placed in the main wellbore casing string and rotated at precise locations, to a predetermined orientation, to allow drilling of multilateral sections through predetermined paths.
2. The main casing string is cemented in place using primary cementing techniques.
3. Because the window joint contains an inner-pressure sleeve, securely held in place including high pressure seal assemblies, it can withstand more than normal pressure buildup and thus maintain pressure integrity against internal or external pressure; plus, it also prevents cutting debris from entering the window opening.
4. After cementing the main casing string, the inner-pressure sleeve is retrieved using a standard fishing spear. The cavity created between the internal sleeve and the, composite material (fiberglass) is filled with a non-compressible fluid medium and thus balanced to the external annulus.
5. The retrievable deflection tool (whipstock) is then landed and installed into the casing window joint.
6. The lateral section is drilled using conventional directional drilling techniques from rotary assemblies to articulated short-radius assemblies, depending on desired wellbore path profile.
7. After total depth of the lateral section has been reached, the drilling assembly is retrieved (while the whipstock is left in place), and the hole is cleaned to ensure that lateral liner and additional completion equipment can be installed.
8. Next, a lateral liner is run in the hole, to the top of which a lateral hanger assembly and specialized running tool are attached. The entire assembly is run into the wellbore on the end of a drillstring.
9. The running tools are run to depth and the lateral hanger assembly is landed within the window joint.
10. A gate closing is activated hydraulically to close a mechanical gate around the hanger, providing a mechanical seal. Surface pressure-recording equipment monitors the gate-travel and gate-closing process.
11. Next, a collet is activated hydraulically for release, and running tools are released and retrieved to surface.
12. With the retrievable deflection tool (whipstock) still there, the lateral is cemented in place using a cementing re-entry guide tool that allows the liner to be cemented using a dual-plug cement procedure.
13. The retrievable deflection tool (whipstock) is either moved to the next window to aid in drilling another lateral or removed from the wellbore.
14. Now, if needed, the lateral section can be re-entered by landing a completion whipstock in the windowed joint for subsequent operations.

Figure 6:
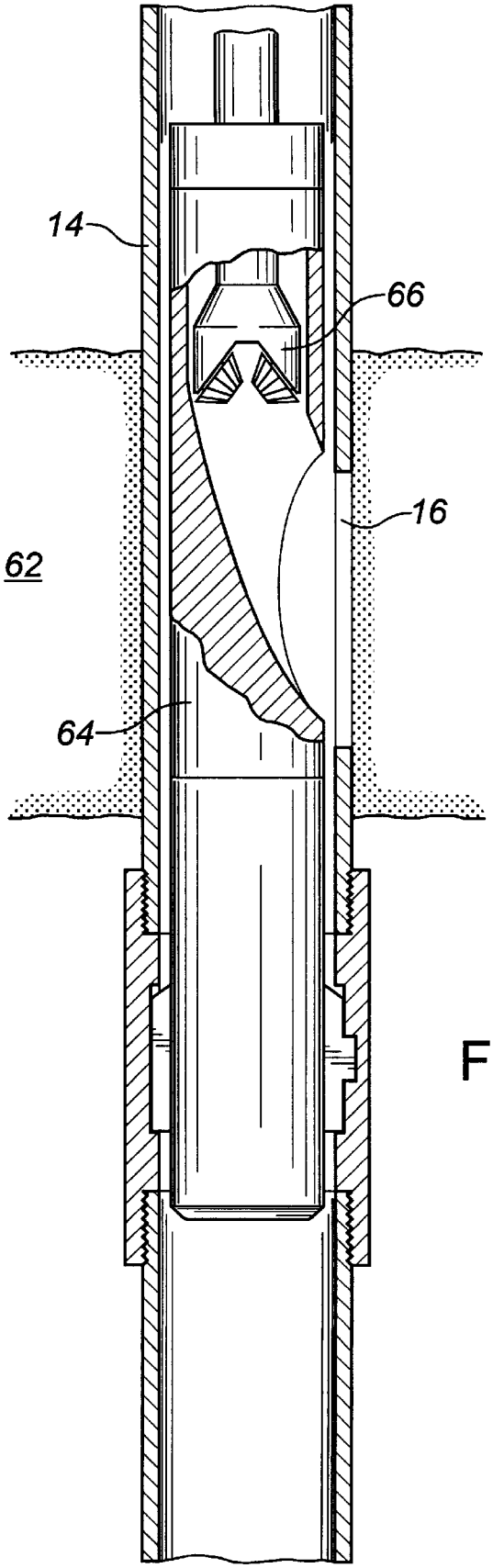
FIG. 6 is a generalized schematic view, partially cut away, illustrating the assembly of the present invention being used to locate, anchor and orient a whipstock.

FIG. 6 illustrates a well casing 14 extending down a vertical bore hole drilled into the earth. A preformed exit port or window 16 in the casing opens to a region of drilling interest 62 situated laterally away from the vertical well bore. A laterally extending bore hole may be drilled to the region 62 using a whipstock assembly 64 indicated within the casing string 14 which deflects a drill bit 66 away from the vertical bore through the casing window 16. This basic technique for forming lateral well bores is well established and described in the prior art.

Thus there has been described herein the preferred embodiment of a system for maintaining the pressure integrity of a casing joint having a easily drillable exit port. However, the invention is to be construed most broadly and to be limited only by the appended claims.

What is claimed is:

1. A casing assembly for use in drilling lateral boreholes, comprising:

a joint of tubular casing having a central passage and a drill bit exit port in a lateral wall thereof;

a removable tubular sleeve fixedly positioned within said central passage of said joint of tubular casing; and a pair of high pressure seal assemblies mounted on said tubular sleeve for sealing the outer surface of said sleeve against the inner surface of said tubular casing on opposing sides of said exit port.

2. The casing assembly according to claim 1, wherein said high pressure seal assemblies each comprise a pair of uni-directional sealing rings disposed in opposition to each other.

3. The casing assembly according to claim 2, wherein said high pressure seal assemblies each further comprise a plurality of spacer rings.

4. The casing assembly according to claim 1, including in addition thereto, at least one layer of drillable material covering said exit port.

5. The casing assembly according to claim 4, wherein said drillable material comprises fiberglass.

6. The casing assembly according to claim 4, wherein a cavity is defined between said sleeve and said drillable material covering said exit port and wherein said cavity is filled with fluid, thereby causing said drillable material covering said exit port to be less sensitive to pressure deformation.

7. The casing assembly according to claim 1, wherein said sleeve is fixedly positioned within said tubular casing with a plurality of shearable fasteners.

8. A casing assembly for use in drilling lateral boreholes, comprising:

a joint of tubular casing having an exit port in a lateral wall thereof;

a tubular sleeve fixedly positioned within the interior of said joint of tubular casing, said tubular sleeve and said tubular casing spaced apart by a distance sufficient to allow removal of said tubular sleeve from said tubular casing; and a pair of high pressure seal assemblies mounted on said tubular sleeve for sealing the outer surface of said sleeve against the inner surface of said tubular casing on opposing sides of said exit port.

9. The casing assembly according to claim 8, wherein said high pressure seal assemblies each comprise a pair of uni-directional sealing rings disposed in opposition to each other.

10. The casing assembly according to claim 9, wherein said sealing ring comprises a generally U-shaped cup and an elastomeric expander ring within said cup for expanding said U-shaped cup in response to pressure.

11. The casing assembly according to claim 9, wherein said high pressure seal assemblies each further comprise a plurality of spacer rings.

12. The casing assembly according to claim 11, wherein said spacer rings are constructed of an industrial laminate.

13. The casing assembly according to claim 12, wherein said industrial laminate comprises a glass based epoxy having a relatively low impact strength and a relatively high compression strength.

14. The casing assembly according to claim 13, wherein the high pressure seal assemblies can withstand pressure in excess of approximately 6,000 psi for a 7 inch casing at 220 degrees Fahrenheit.

15. The casing assembly according to claim 13, wherein the high pressure seal assemblies can withstand pressure in excess of approximately 14,000 psi for a 9.625 inch casing at 220 degrees Fahrenheit.

16. The casing assembly according to claim 13, wherein the high pressure seal assemblies can withstand pressure in excess of approximately 6,000 psi for a 7 inch casing and approximately 14,000 psi for a 9.625 inch casing at 220 degrees Fahrenheit.

* * * * *